US005871789A

United States Patent [19]

Romagnoli

[11] Patent Number: 5,871,789

[45] Date of Patent: Feb. 16, 1999

[54] MACHINE FOR MAKING COMPLETE TEA BAGS FOR INFUSION IN A LIQUID IN WHICH THE INFUSABLE PRODUCT IS CONTAINED IN A FILTER BAG MADE OF HEAT-SEALED, POROUS MATERIAL

[75] Inventor: Andrea Romagnoli, San Lazzaro Di Savena, Italy

[73] Assignee: Tecnomeccanica S.r.l., Bologna, Italy

[21] Appl. No.: 751,638

[22] Filed: Nov. 18, 1996

[30] Foreign Application Priority Data

Dec. 7, 1995 [IT] Italy ..... BO95A0574

[51] Int. Cl.[6] ..... B65B 9/06; B65B 29/04; B65D 81/34

[52] U.S. Cl. ..... 426/77; 53/413; 53/134; 426/79; 426/80; 426/83

[58] Field of Search ..... 426/77–84, 110, 426/112, 115, 119, 394; 206/0.5; 99/295, 321, 323; 383/38; 53/134, 234, 117, 171, 540, 550; 156/466, 510, 553, 568

[56] References Cited

U.S. PATENT DOCUMENTS

| | | | |
|---|---|---|---|
| 3,415,656 | 12/1968 | Lundgren | 426/394 |
| 4,288,224 | 9/1981 | Romagnoli | 493/345 |
| 4,415,597 | 11/1983 | Romagnoli | 426/394 |
| 4,433,798 | 2/1984 | Romagnoli | 222/225 |
| 4,437,294 | 3/1984 | Romagnoli | 53/553 |
| 4,828,851 | 5/1989 | Romagnoli | 426/79 |
| 4,829,742 | 5/1989 | Romagnoli | 53/134 |
| 4,856,257 | 8/1989 | Romagnoli | 53/134 |
| 4,870,808 | 10/1989 | Romagnoli | 53/529 |
| 5,366,741 | 11/1994 | Van Der Zon | 426/79 |
| 5,511,359 | 4/1996 | Kenney | 53/413 |

FOREIGN PATENT DOCUMENTS

| | | |
|---|---|---|
| 489554 | 6/1992 | European Pat. Off. . |
| 652164 | 5/1995 | European Pat. Off. . |
| WO95/10462 | 4/1995 | WIPO . |
| WO95/27666 | 10/1995 | WIPO . |

*Primary Examiner*—Stephanie W. Zitomer
*Attorney, Agent, or Firm*—Fay, Sharpe, Bealle, Fagan, Minnich & McKee

[57] ABSTRACT

A machine and process for making complete tea bags comprising a filter bag and thread for holding the filter bag. The machine comprises a continuously turning wheel, whose lateral surface has pins which can move from a rest position, where they are retracted into the lateral surface, to a working position where they protrude from the wheel; the wheel assembles a strip of porous material with the thread, with a pickup tag and with the infusable product in such a way as to form tea bags where the thread is arranged in a closed loop inside the filter bag, together with the infusable product, and is attached to the edges of the filter bag to form a particularly resistant fastening during infusion.

27 Claims, 9 Drawing Sheets

FIG 9A
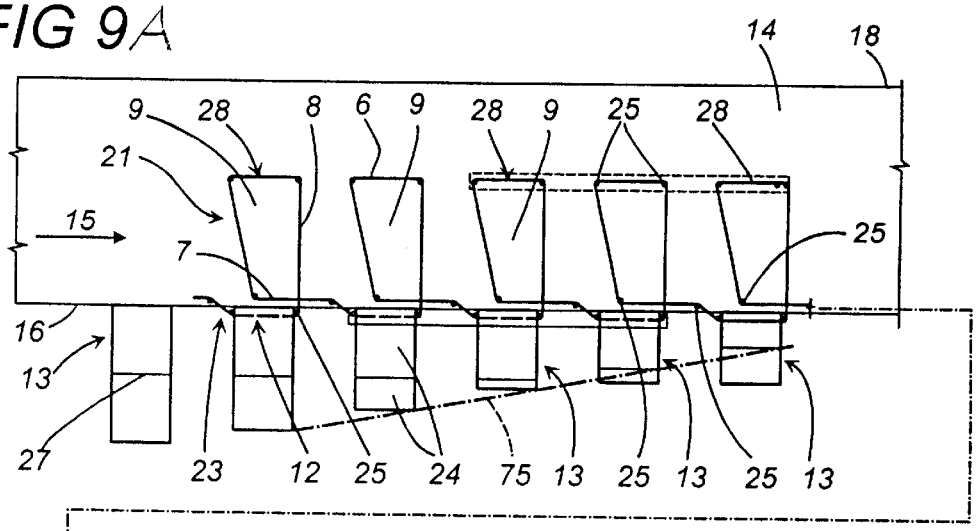
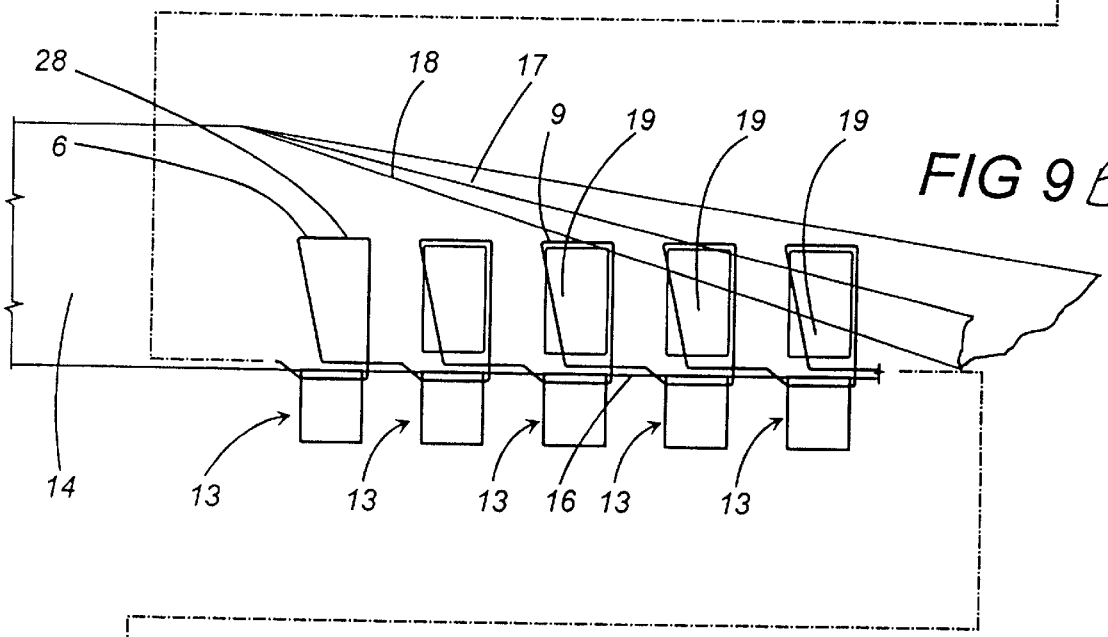
FIG 9B
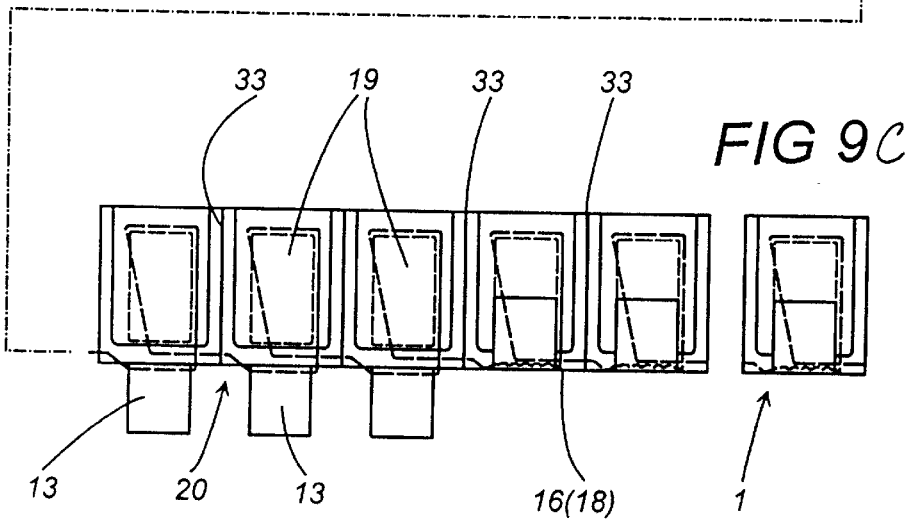
FIG 9C

FIG 10
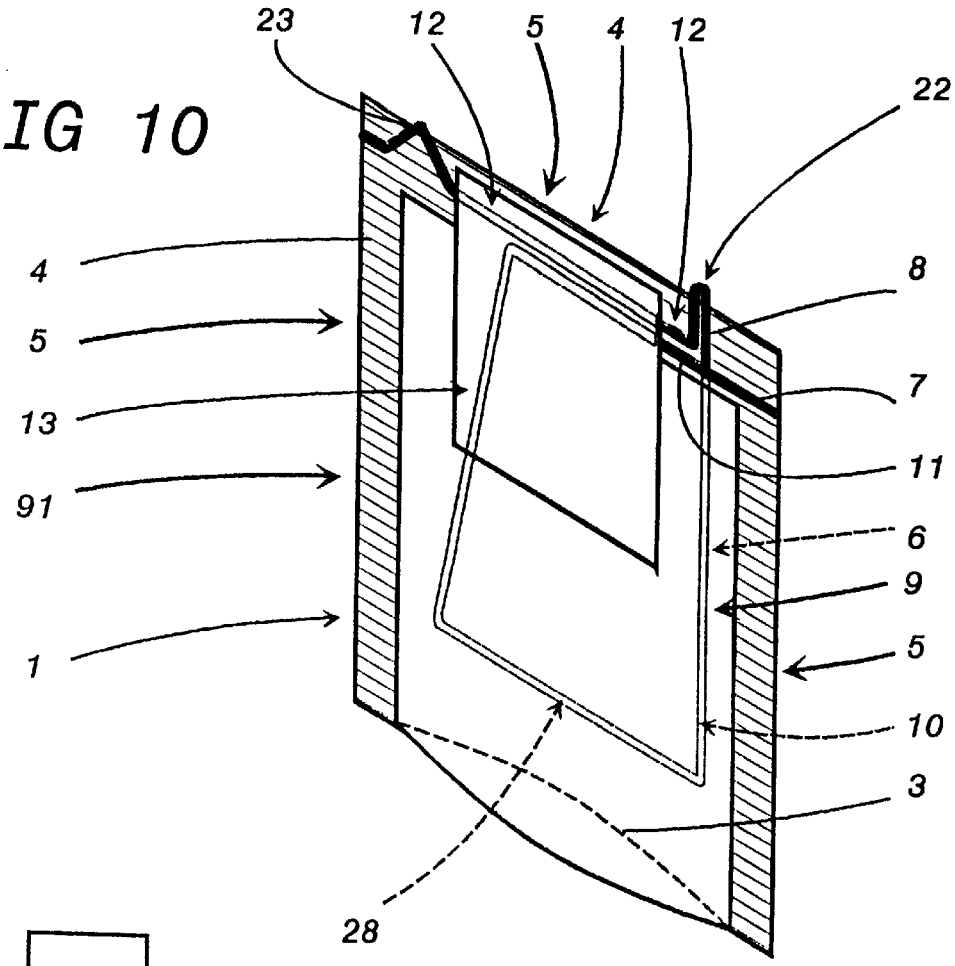
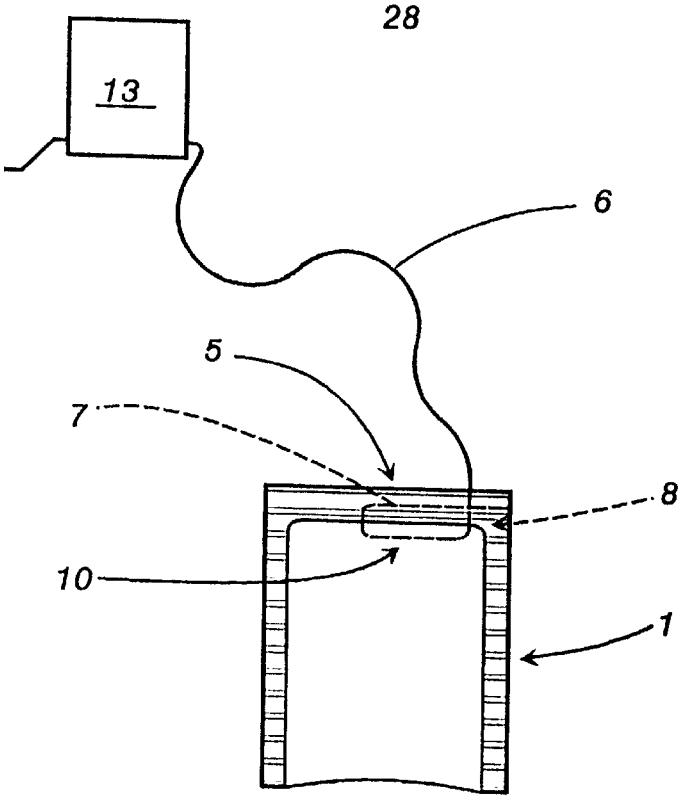
FIG 11

MACHINE FOR MAKING COMPLETE TEA BAGS FOR INFUSION IN A LIQUID IN WHICH THE INFUSABLE PRODUCT IS CONTAINED IN A FILTER BAG MADE OF HEAT-SEALED, POROUS MATERIAL

BACKGROUND OF THE INVENTION

The present invention relates to a machine for making tea bags for infusion in liquid.

The invention relates in particular to a tea bag making machine which uses a process whereby an infusable product, in loose form, is measured and fed into a filter bag consisting of folded sheets of porous material, heat-sealed to each other and equipped with a thread for holding the filter bag during infusion. The machine relates in particular to the making of filter bags containing tea or chamomile without thereby restricting the scope of the disclosure but including also herbs and any other products capable of being infused in a liquid.

In the tea and chamomile filter bag sector, it is very important that the thread be fastened to the filter bag very securely to prevent it from coming loose when the filter bag is immersed in the infusion liquid.

Indeed, stirring and agitating the tea bag during infusion, for example with a teaspoon, in order to speed up the infusion process is such a widespread tendency that tea bag manufacturers in some countries must conform with technical standards that specify a minimum limit of resistance to detachment of the filter bag from the thread, below which filter bags are considered unacceptable because they cannot provide consumers with a sufficient guarantee of not coming loose during infusion.

In the case of filter bags made by heat-sealing, one known solution envisages the formation of a small portion of loop with one end of the thread, the portion of loop being held between the overlaid, heat-sealed edge flaps of the sheets of porous material and fixed to them by two short sections impregnated with the adhesive with which the edge flaps are heat-sealed to each other.

This solution, although simple in construction, does not provide a sufficient guarantee of meeting the minimum requirement of resistance to detachment enabling the thread to remain securely fixed to the filter bag during infusion.

The present invention has for an object to provide a machine for making tea bags capable of solving the problem mentioned above.

SUMMARY OF THE INVENTION

An automatic machine with a continuously rotating wheel equipped with radially mounted moving pins, operating in combination with a series of work heads arranged round its periphery which forms a filter bag in which the fastening thread is arranged in such a way that sections of it cross the edges of the filter bag intersecting each other to form a closed loop. A first section of the loop is located inside the filter bag between the sheets of porous material, whilst a second section is located between the sealed margins forming one edge of the filter bag.

The arrangement of the thread inside the filter bag is such that when either of the sections of thread is pulled, the thread runs through the edge, thus reducing the length of the first section of the loop and tightening it to form a knot against the edge in such a way as to keep the filter bag securely fastened to the thread during infusion.

In a preferred embodiment, the automatic machine made in accordance with the invention envisages an arrangement of the thread such that a tag for holding the tea bag can also be attached by heat-sealing, the tags being fed to the wheel by an appropriate intermittent feeder synchronized with the wheel itself.

The special arrangement of the thread in order to fasten it securely to the filter bag allows the entire tea bag making process to be carried out while keeping practically the entire length of the thread (corresponding to the section necessary to form the fastening that holds it to the bag during infusion) inside the filter bag.

This makes it possible for the filter bags to be moved along the machine with relative ease without the need for the complex mechanical assemblies normally required by automatic machines to handle a loose, shapeless element as is the thread.

Consequently, the machine made according to the invention is relatively simple in construction and economical.

Moreover, the machine made according to the invention, although it makes known types of filter bags that are heat-sealed on three sides, is structured in such a way as to allow the infusable product to be fed into the bags during the forming process by means of rotary-type feeders.

Compared with known machines, which are designed to make similar products and which are equipped with gravity feeders, the machine made according to the invention works much faster an has a markedly higher output per hour.

The working speed, which is completely unrelated to height because it is not a gravity feed system, may also be adjusted according to requirements and is limited only by the setting time of the adhesives used for heat-sealing the edges of the bag.

The present invention also discloses a process comprising the following steps:

- feeding a continuous strip of porous material along a lengthways direction of feed;
- laying on the strip of a thread following a continuous path including a series of closed loops at regular intervals, each loop having two mutually intersecting sections, a first lengthways section of which is released close to a first margin of the strip, and a second crossways section being, instead, arranged in such a way that it crosses the first margin, and, while the thread is being laid in this way, a portion of a loop of thread is also formed which protrudes from the first margin of the strip and whose ends are connected, respectively, to the crossways section of a first loop and to the lengthways section of a second loop adjacent to it;
- holding against the strip of at least a second lengthways section of the loop of thread located further away from the first margin than the first lengthways section;
- depositing on top of the loops on the strip a succession of charges of infusable product;
- folding a second margin of the strip over the first margin to make a tubular receptacle that closes over the charges of product;
- lengthways and crossways sealing of the receptacle to form a continuous succession of filter bags sealed on three sides;
- cutting the tubular receptacle at regular intervals.

BRIEF DESCRIPTION OF THE DRAWINGS

Further characteristics of the invention according to the abovementioned objects are laid out in the claims below and the advantages of the disclosure are apparent from the detailed description which follows, with reference to the accompanying drawings, which illustrate preferred embodiments of the invention and in which:

FIGS. 9A–9C are a schematic representation of the entire process cycle used by the machine to make tea bags;

FIG. 10 is a perspective representation of the filter bag made by the machine;

FIG. 11 shows the tea bag illustrated in FIG. 10 as it appears when in use;

DESCRIPTION OF THE PREFERRED EMBODIMENTS

Figure 1:
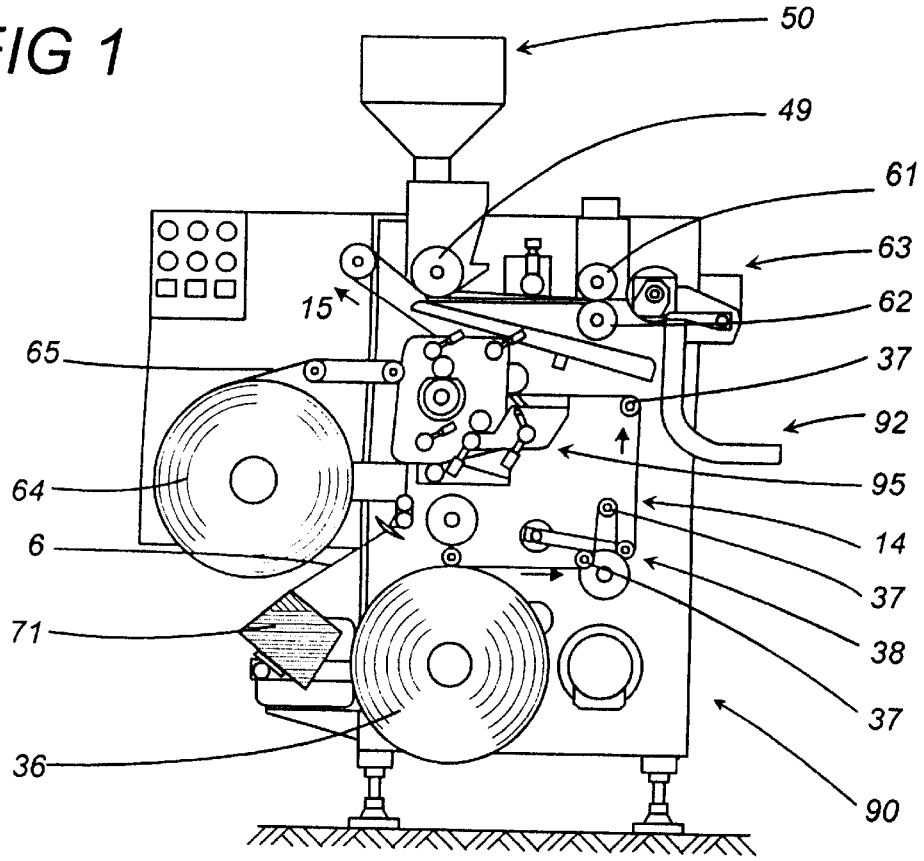
FIG. 1 is a schematic general elevation view of a machine made according to the invention.
Figure 5:
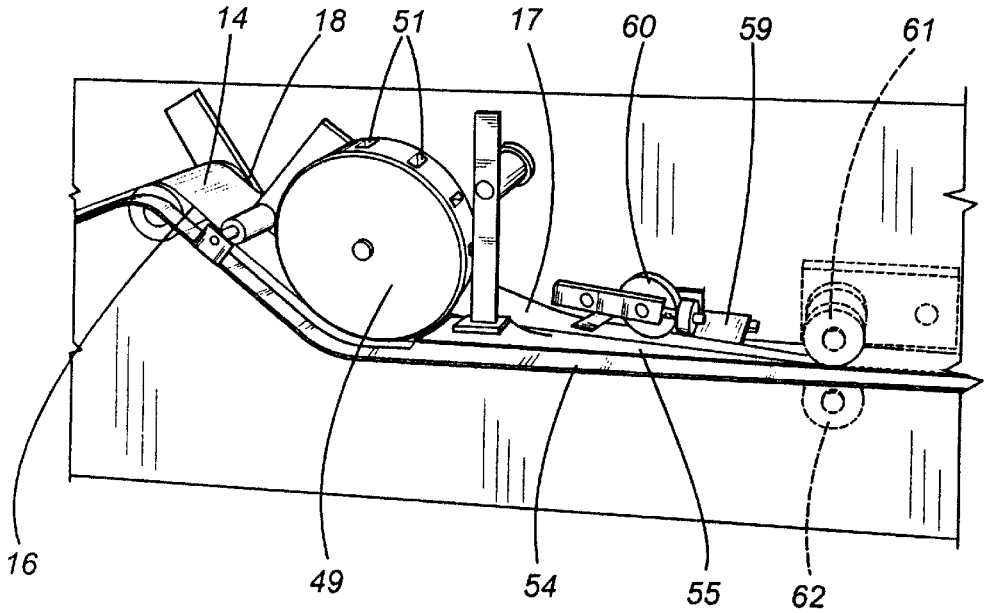
FIGS. 5, 6, 7 and 8 are perspective views of a part of the machine which feeds charges of infusable product and forms the receptacle containing the charges of the product.

With reference to FIG. 1, the numeral 90 indicates as a whole a machine for making a complete tea bag 91 illustrated in detail in FIG. 10.

The tea bag 91 comprises a filter bag 1 containing a charge of infusable product for infusion in a liquid and is formed of sheets of porous material 2 and 3, preferably filter paper, folded and sealed along three margins 4 to form sealed edges 5 of the filter bag 1.

The tea bag 91 also comprises a thread 6 used for holding the filter bag 1 during infusion and fastened to the upper edge 5 of the filter bag 1 and to a tag 13 used for picking up the filter bag 1 itself.

FIG. 10 also shows that the thread 6 has sections 7 and 8, arranged lengthways and crossways, respectively, in relation to the upper edge 5 and intersecting each other to form a closed loop 9. A first section 10 of the closed loop 9 is located inside the filter bag 1, between the sheets 2 and 3 of porous material. A second section 11, on the other hand, is located between the margins 4, which are sealed to each other to form the upper edge 5 of the filter bag 1.

On the outside of the filter bag 1, the thread 6 is fastened to the upper edge 5 in such a way as to form a protruding portion of loop 12, to which the pickup tag 13 is fixed.

The portion of loop 12 allows the pickup tag 13 to hang loosely from the filter bag 1.

The lengthways and crossways sections 7 and 8 of the thread are impregnated in the adhesive used to form the edge 5. The lengthways section 7, the longer one, is more slip resistant than the crossways section 8, which is shorter (see FIG. 11) when the thread 6 is pulled from the outside of the filter bag 1. Hence, under the pulling action, the crossways section 8 of the thread 6 slides outwards in such a way as to shorten the first section 10 of the loop 9, tightening it against the edge 5 of the filter bag 1 and creating a particularly resistant fastening of the thread 6 on the filter bag 1.

With reference to FIG. 1 again, it may be observed that the tea-bag making machine 90 basically consists of a central section 95 around which there is mounted a plurality of work heads that interact with it.

Figure 2A:
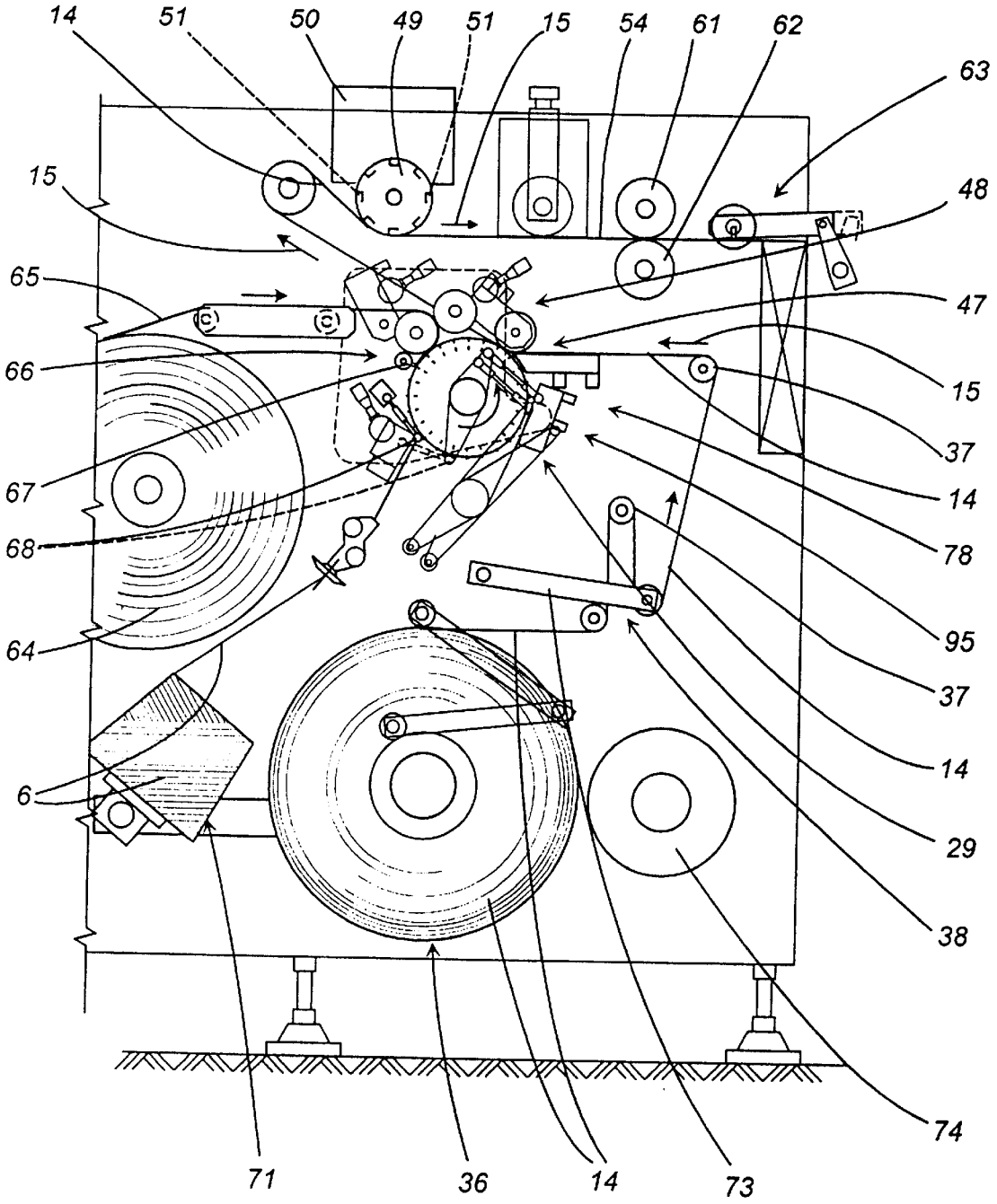
FIGS. 2*a* and 2*b* are enlarged partial views of the machine as illustrated in FIG. 1 and with some parts cut away for clarity.

The central section 95 (see FIGS. 2*a*, 2*b* and 3) comprises in particular a wheel 29 that has an internal cavity 69 and that rotates continuously about its geometric axis 30, the said wheel being made in two cylindrical, coaxial halves 34 and 35 adjacent to each other along the axis of rotation 30, and together defining a cylindrical lateral surface 31.

The lateral surface 31 of the wheel 29 is equipped with pins 25 housed inside radial cavities 32 in the wheel 29, intercommunicating with the internal cavity 69.

The pins 25, driven by appropriate actuating means, move from a rest position, where they are retracted completely into the cavities 32 in the lateral surface 31, to a working position where, instead, they protrude from the latter outwards from the wheel 29.

The actuating means that drive the pins 25 comprise a cam 70, housed and rotating in the cavity 69 in the wheel 29, which acts on the ends of the pins 25 in such a way as to push them out of, or make them retract into, the radial cavities 32 in accordance with the different steps in the process cycle of the machine 90.

Round the periphery of the rotating wheel 29, the machine 90 envisages the following:

- means 36, 37 and 38 for feeding a continuous strip of porous material 14;
- means 64, 66 and 67 for feeding the tags 13 used for picking up the filter bag 1;
- means 71 for feeding the thread 6;
- means 47, 47' and 48 for holding the thread 6 against the strip of porous material 14;
- means 49 and 50 for feeding charges of infusable product;
- means 52, 54, 55, 59; 552, 592 and 594 for folding the strip of porous material 14;
- sealing means 61 and 62; and lastly
- cutting means 63.

The means for feeding the strip of porous material 14 consist of a roll 36 on which the continuous strip of porous material 14 is wound, a series of feed rollers 37 and a sensor 38 which controls the tension of the strip 14;

The latter unwinds from the roll 36 and is fed to the first half 34 of the wheel 29 following a feed path defined by the feed rollers 37.

After being wound round the lateral surface 31 of the wheel 29, the strip 14 advances along the machine 90 following a lengthways feed direction 15 which conveys it towards an outfeed section 92 of the machine 90, as will be described in more detail below.

The sensor 38 includes a counterweight roller 72 related to the strip of paper 14 and mounted on the end of a tensioner arm 73 connected with a variable speed motor 74, the latter being controlled by the position of the arm 73 in such a way as to keep the feed rate of the strip 14 along the machine constant.

The means that feed the tags 13 used for picking up the filter bag 1 include: a roll 64 of pickup tags 13 in the form of a continuous strip 65, made of heat-sealable material and a strip 65 unwinding unit 66 equipped with a rotary knife 67 mounted peripherally in relation to the wheel 29.

The strip 65 is fed to the wheel 29 and, moving in synchrony with the latter, is positioned at the second half 35 of the wheel 29, close to a first margin 16 of the strip 14, where it is held in place by appropriate holding means consisting preferably of suction cups 68 mounted on the second half 35 of the wheel 29.

The rotary knife 67, whose peripheral speed is greater than the speed of rotation of the wheel 29, cuts the strip of pickup tags 13 at regular intervals, causing the tags to move along the wheel 29 at a tangent until they are stopped by a pair of pins 25 (see FIG. 4) on the second half 35 which protrude from the lateral surface 31 of the wheel 29. The single pickup tags 13 are thus placed intermittently at preset intervals on the lateral surface 31 of the wheel 29 and along a lengthways direction of feed 15.

Figure 2B:
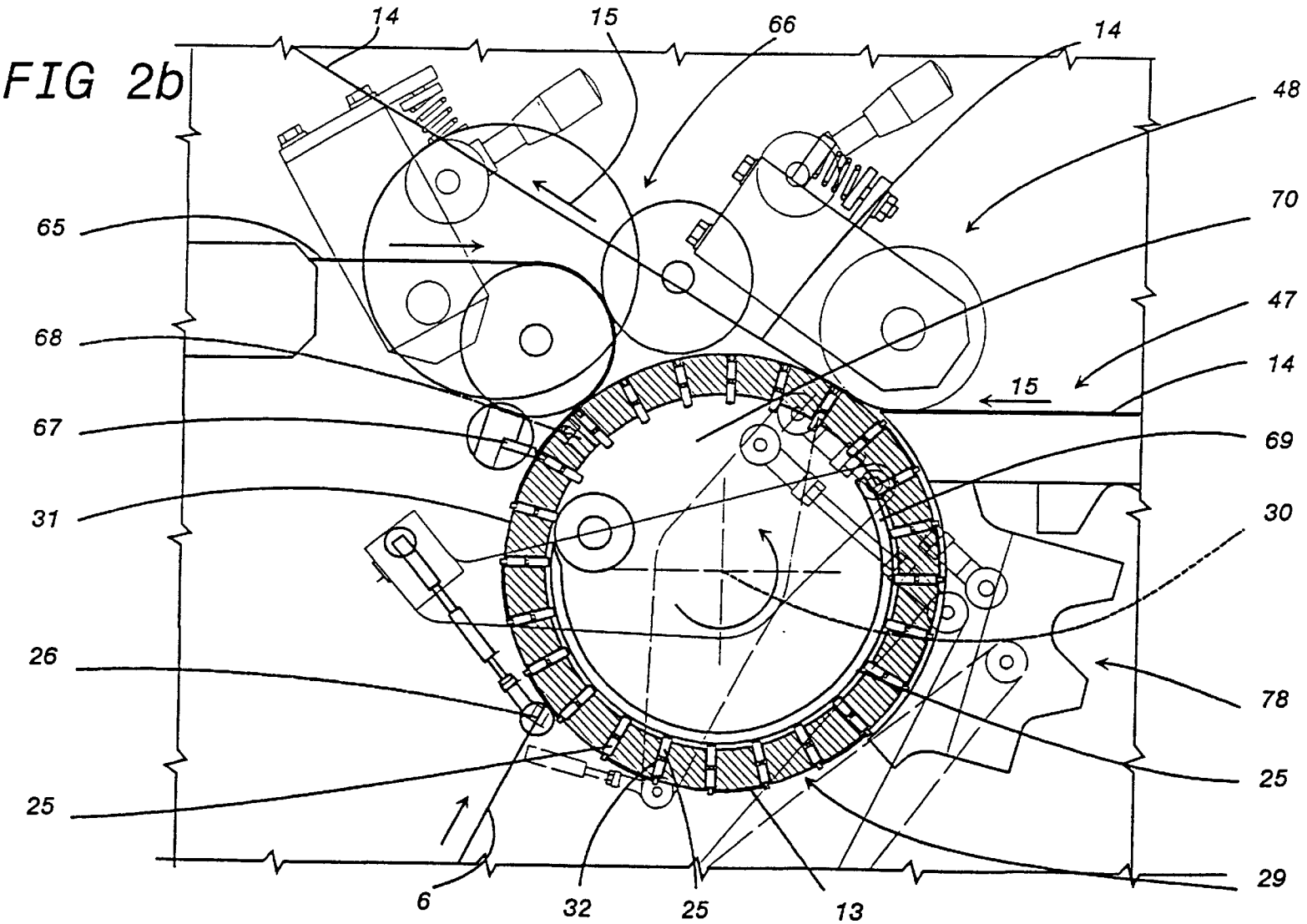

The thread 6 feeding means send the thread 6 to a distributor nozzle 26 (see FIG. 2*b*). The latter is mounted close to the lateral surface 31 of the wheel 29 and is driven by actuating means 39, 43 and 45 in such a way as to lay the thread 6 on the strip of porous material 14, round the pins 25, following a path 21 that includes a succession of closed loops 9 shaped as described above in connection with the arrangement of the thread 6 in the filter bag 1, illustrated in FIGS. 4 and 10. The actuating means acting on the nozzle 26 (see FIG. 3) consist of the following parts: a right-angled lever 39 mounting the distributor nozzle 26 at one end 40 and having an actuating end 41 and an intermediate joint 42; a first arm 43 coaxial with the wheel 29, mounted in such a way that it can rotate about its axis of symmetry 30 and mounting a cam-operated actuator 44 connected to the actuating end 41 of the right-angled lever 39; and, lastly, a second arm 45, also coaxial with the wheel 29 and mounting a pivot 46 for the intermediate joint of the right-angled lever 39.

The first and second arms 43 and 45 are motor-driven in such a way as to swing relative to each other and relative to the wheel 29 so as to swing the nozzle 26 accordingly in such a manner as to allow it to describe the said path 21 round the pins 25 remaining constantly at the same distance from the lateral surface 31 of the wheel 29.

The means which hold the thread 6 against the strip of porous material 14 include a hot air heater 47 (see FIGS. 2*a*, 2*b* and 3) mounted peripherally in relation to the wheel 29 and placed at a convenient distance from the first margin 16 of the strip 14, measured according to the axis of rotation 30 of the wheel 29. The activation of the heater 47 causes spots of adhesive on the strip of porous material 14 to melt at the first and second lengthways sections 7 and 28 of the loops 9 of the thread 6.

The holding means include a pressure element 48 designed to press the thread 6 onto the strip of porous material 14, using the wheel 29 as contact surface, so as to make the thread adhere to the strip 14 after the adhesive has melted.

Similar heating means 78 (see FIGS. 2*a*, 2*b*) are envisaged, preferably just upstream of the wheel 29, in relation to the counterclockwise direction of rotation, to act in the same way on the filter bag 1 pickup tag 13 to heat seal it to the loop 12 of the thread 6 that protrudes from the first margin 16 of the strip 14.

Figure 3:
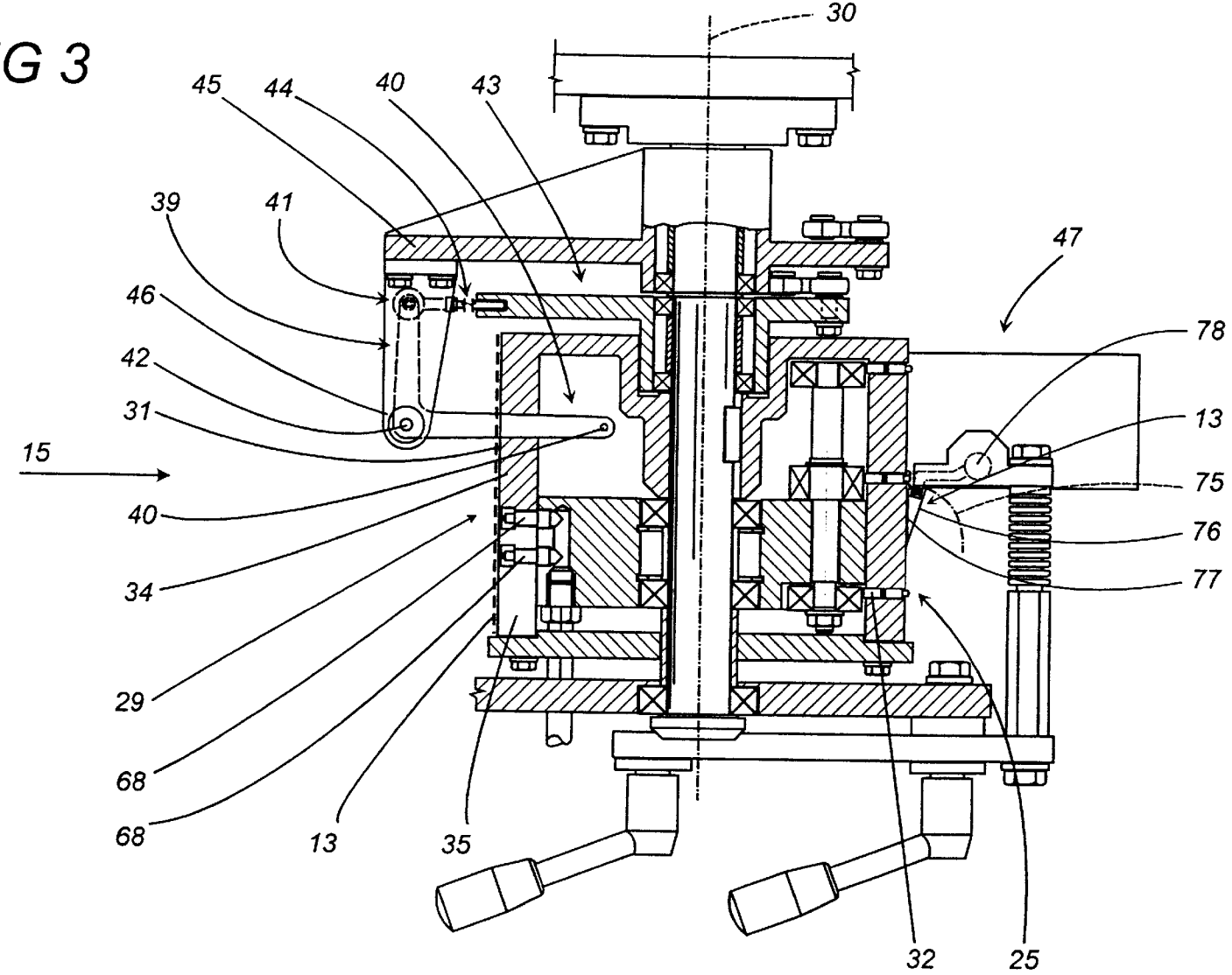
FIG. 3 is an enlarged detail of the machine, viewed from the side and with some parts cut away for clarity.
Figure 4:
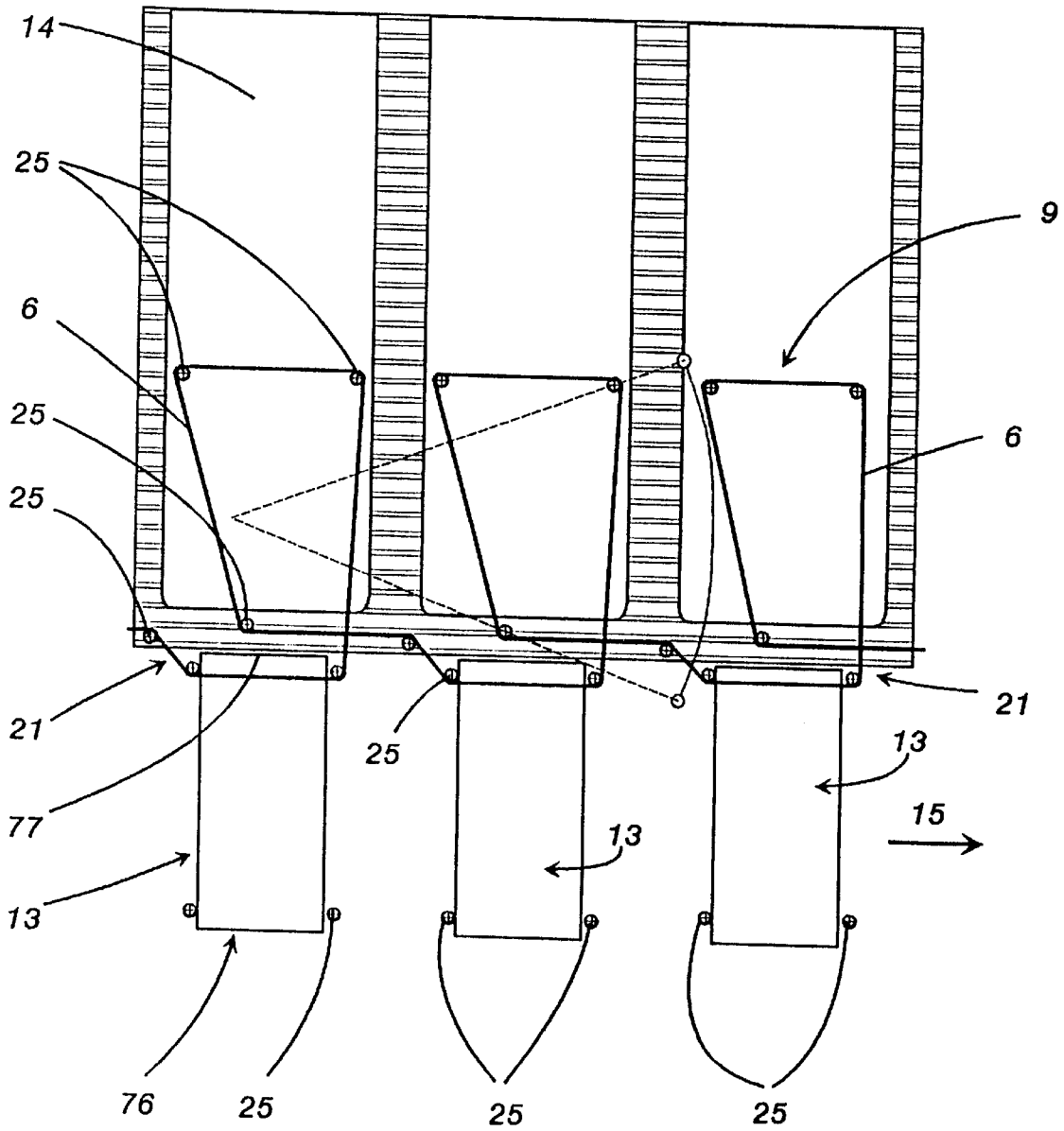
FIG. 4 is an enlarged plan view showing the arrangement of the fastening thread inside the tea bag during the formation of the latter on a machine made according to the invention.
Figure 6:
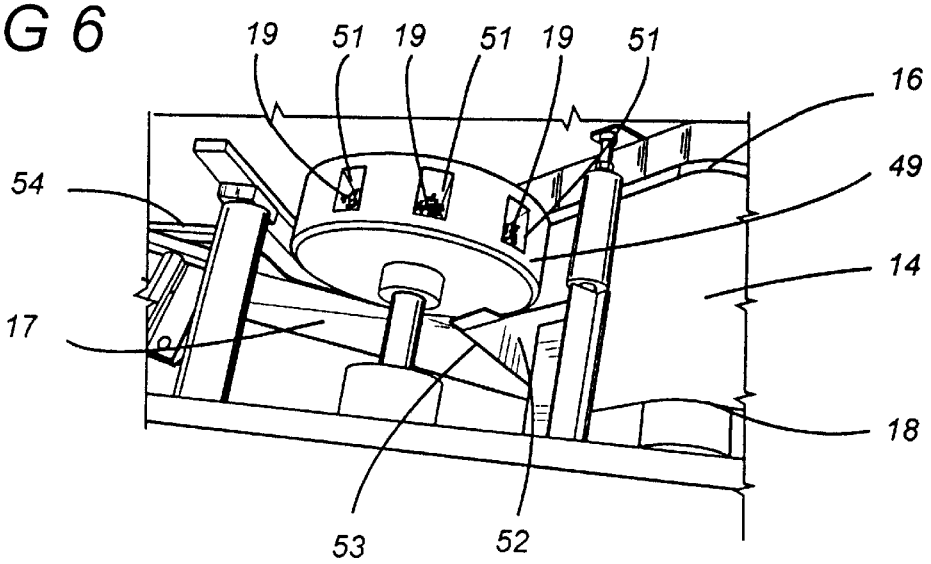
Figure 7:
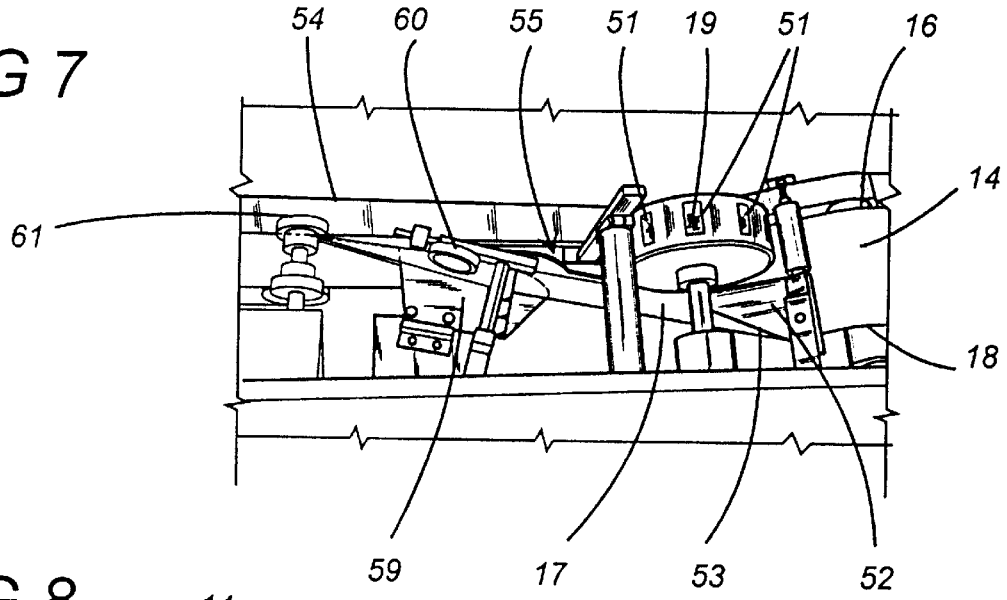
Figure 8:
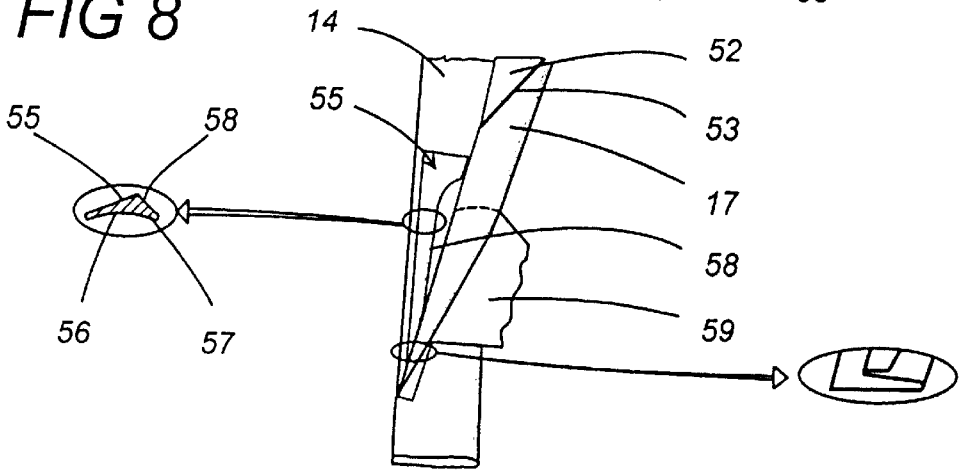

With reference to FIG. 3 or 4, it can be seen that the pickup tag 13 moves forward together with the wheel 29, is engaged on the side 76 opposite the side 77 where the thread 6 is by a helical path 75 (illustrated schematically) or by similar equivalent means which gradually fold it onto itself but without bringing the sides 76 and 77 into contact with each other.

When the heating means 78 are activated, a jet of hot air is blown onto the facing surfaces of the sides 76 and 77, so as to melt the adhesive which the pickup tag 13 also has on it.

When the pickup tag 13 and the strip of porous material 14 reach the abovementioned pressure element 48, the latter also presses against the pickup tag 13, which is thus definitively connected to the portion of loop 12 of the thread 6.

Figure 13:
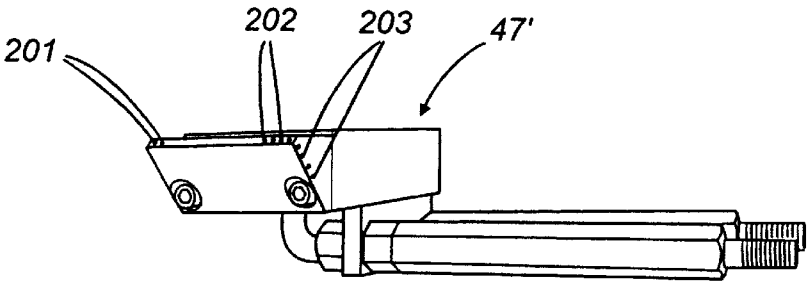
FIG. 13 is an enlarged, perspective view of heating means equivalent to the heating means illustrated in FIG. 2*a* but made according to another embodiment of the invention.

Another embodiment of the heating means is illustrated in FIG. 13. This figure shows that a single heater 47', supplied by hot air, also includes the heating means 78 acting in the same way as described above on the tags 13 used for picking the filter bag 1.

In particular, FIG. 13 shows that the single heater 47' has sets of holes 201 202 and 203 through which jets of hot air are directed at the strip of porous material 14.

Two sets of holes 201 and 202 are arranged along a line parallel to the axis 30 of the wheel 29 and direct the hot air flow at the first and second lengthways sections 7 and 28 of the thread 6 in such a way as to melt the adhesive material.

The third set of holes 203 extends along a curved edge of the heater 47' opposite a circular arc of the wheel 29 in such a way as to interact with the opposing surfaces 76 and 77 of the pickup tags 13 during folding and to melt the adhesive on in the same way as envisaged for the heating means 78 shown in FIG. 3.

The means which feed charges of infusable product (see FIGS. 1 and 2*a*) include a rotor 49 connected with a container 50 with infusable product in loose form in it.

The rotor 49 has feed cavities 51 located at regular intervals round its outer surface. Since the strip 14 can move at a tangent to the rotor 49 at a speed identical to the peripheral speed of the rotor, the charges of product 19 in the individual cavities 51, during the rotation of the rotor 49 are placed on top of the loops 9 of thread 6 on the strip 14 at regular intervals along the lengthways direction of feed 15.

Connected with the feed means 49 and 50, the tea bag making machine 90 also comprises the abovementioned means 52, 54, 55 and 59 for folding the strip of porous material 14 (a first preferred embodiment of which is illustrated in FIGS. 5,6,7 and 8).

These folding means, in particular include a first flat folding element 52, a contact surface 54, a pressure foot 55 and a second flat folding element 59.

The first flat folding element 52 is located on the side of the feeder means 49 and 50 and over the strip of porous material 14. Also, one of its edges 53 is angled in relation to the second margin 18 of the strip of porous material 14, opposite the first margin 16.

The contact surface 54 of the strip of porous material 14 is horizontal but at an angle to the plane in which the first flat folding element 52 lies.

The front 56 of the pressure foot 55 interacts with the contact surface 54 in such a way as to press the strip 14 against it. It also has a back 58 which, together with the front 56, defines an edge 57 that intersects the edge 53 of the first flat folding element 52 so that together they define a triangular flap 17 on the second margin 18 of the strip 14.

The second flat folding element 59 moves in parallel and at right angles to the strip 14 and is equipped with a strip 14 pressure roller 60 which, acting in combination with the back 58, enables the second margin 18 of the strip 14 to be gradually folded and laid over the first margin 16.

Working in the manner described above, the folding means fold the strip 14 to form a tubular receptacle 20 which gradually closes over the charges of infusable product 19 deposited on the strip 14 itself.

Figure 12:
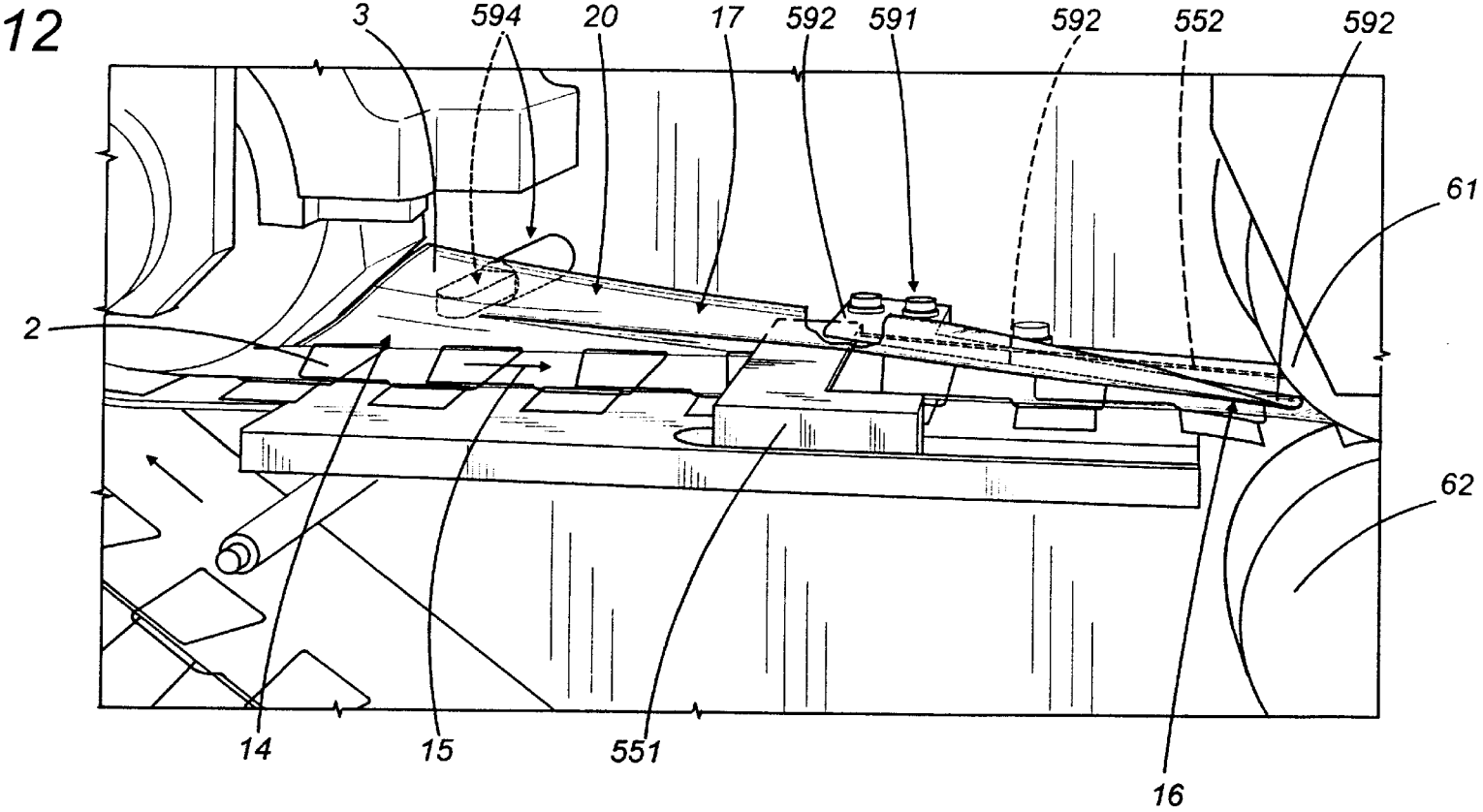
FIG. 12 is an overall, enlarged perspective view of a section of the machine equipped with folding means equivalent to the folding means illustrated in FIGS. 5, 6, 7 and 8 but made according to another embodiment of the invention.

An alternative, constructionally very simple, embodiment of the folding means is illustrated in FIG. 12. As shown in this figure, the aforesaid folding means consist basically of a pressure foot 551, a folding element 591 and a stop finger 594 interacting with each other to form the said tubular receptacle 20.

The pressure foot 551 is fixed to the machine structure and mounts a first elongated element 552 which is placed over the strip of porous material 14 lengthways with respect to the said strip 14.

The folding element 591 in turn mounts a second elongated element 592 which is placed crossways over the strip of porous material 14 and oriented at an angle to the first elongated element 552 in such a way that its furthest end is closer to the first margin 16 of the strip 14.

The finger 594 is mounted further upstream, along the strip 14 direction of feed 15. One of the margins 18 of the strip of porous material 14 winds once round the first folding element 552 and then, passing between the first and second folding elements 552 and 592, a second time round the second folding element 592, in the opposite direction, so as to form a flap 17 stopped at the back by the finger 594.

The flap 17 formed in this way allows the charges of infusable product to be deposited on the underlying sheet 2, which is not folded, and to form the tubular receptacle 20 as the strip 14 moves along the direction of feed 15.

Downstream of the folding means, proceeding in the lengthways direction of feed 15, the machine 90 envisages the abovementioned sealing means. The latter, by means of a pair of counter-rotating rollers 61 and 62 located on each side of the tubular receptacle 20, seal the overlaid margins 16 and 18 of the strip 14 lengthways and, at the same time, seal the tubular receptacle 20 crossways at regular intervals to form a succession of filter bags 1 along the receptacle 20.

The cutting means 63 then cut the tubular receptacle 20 in synchrony, thus separating the filter bags 1 from one another and sending them to the outfeed section 92 of the machine 90.

The operation of the machine 90 will now be described with reference to the tea bag making process illustrated schematically in FIG. 9, with sections labelled A, B and C.

With reference to FIG. 9-A, it can be observed that the process comprises the following steps:

feeding a continuous strip of porous material 14 along a lengthways direction of feed 15;

intermittent, synchronized feeding of tags 13 used for picking up the filter bags 1, the tags being placed close to the first margin 16 of the strip of porous material 14;

scoring the pickup tag 13, laid out flat, along the crossways center line 27 so as to form two adjacent, co-planar flaps 24;

laying the thread 6 on the continuous strip of porous material 14 and round the pins 25 protruding from the lateral surface 31 of the wheel 29, following continuous paths 21 including a series of closed loops 9 at regular intervals, each loop having two mutually intersecting sections 7 and 8, a first lengthways section of which 7 is released close to the first margin 16 of the strip 14, and the second crossways section 8 being, instead, arranged in such a way that it crosses the first margin 16; while the thread is being laid in this way, the portion of loop 12 of the thread 6 is also formed on top of the individual pickup tags 13, one end 22 of the loop portion being connected to the crossways section 8 of the first loop 10 and the opposite end 23 being connected to the lengthways section 7 of the loop 9 of thread 6 adjacent to the first loop 10;

heat-sealing the pickup tag 13 to the portion of loop 12 of the thread 6;

gradually folding the pickup tag 13 onto itself against the helical track 75, starting with the flaps 24 of the pickup tag 13 co-planar and ending with the flaps overlaid on either side of the portion of loop 12;

holding the thread 6 loop 9 first and second lengthways sections 7 and 28 against the strip 14, the said sections being located, respectively, closer to, and further away from, the first margin 16 of the strip 14;

retracting the pins 25 into the radial cavities 32 in the wheel 29;

pressing, by the pressure element 48, of the thread 6 onto the strip of porous material 14 and of the pickup tag 13 onto the portion of loop 12 (see FIG. 9-B);

forming the triangular flap 17 on the second margin 18 of the strip 14, opposite the margin 16 connected with the lengthways and crossways sections 7 and 8 of the thread 6;

depositing on top of the thread loops 9 of a succession of charges 19 of infusable product at regular intervals laterally with respect to the flap 17;

positioning the flap 17 in the lengthways direction of feed 15 until the opposite margins 16 and 18 of the strip 14 are laid over each other to form a tubular receptacle 20 gradually closing over the charges of product 19;

sealing the tubular receptacle 20 lengthways continuously along the margins 16 and 18 and at intervals crossways along the lines 33 (see FIG. 9-C);

rotating the pickup tags 13 about the first margin 16 so as to flip each pickup tag 13 onto the tubular receptacle 20;

cutting the tubular receptacle 20 at regular intervals to separate the filter bags 1.

The invention described can be subject to modifications and variations without thereby departing from the scope of the inventive concept. Moreover, all the details of the invention may be substituted by technically equivalent elements.

What is claimed:

1. A machine for making complete tea bags comprising a filter bag containing infusible product for infusion in a liquid and formed of sheets of porous material sealed together along their margins to form sealed edges of the filter bag, and comprising also a thread used for holding the filter bag during infusion, the machine comprising:

a wheel that rotates about its axis and that has a lateral surface equipped with pins housed inside radial cavities in the wheel, the said pins being driven by actuating means from a rest position where they are retracted completely into the cavities in the lateral surface to a working position where they protrude from the lateral surface outwards from the wheel;

means for feeding a continuous strip of porous material wound round the lateral surface of the wheel and moving in a lengthways direction of feed;

means for feeding a continuous thread to a distributor nozzle mounted close to the lateral surface of the wheel and driven by actuating means to lay the thread on the strip round the pins following a continuous path that includes a succession of closed loops placed at regular intervals, each loop having two mutually intersecting, lengthways and crossways sections, a first lengthways section of which is released close to the first margin of the strip and the second crossways section being arranged to cross the first margin, the said path also including a portion of loop of thread that protrudes from the said first margin;

means for holding against the strip at least one second lengthways section of thread that is further away from the first margin than the first lengthways section;

means for depositing a succession of charges of infusible product on the strip of porous material, on top of the loops of thread;

means for folding a second margin of the strip over the first margin to form a tubular receptacle that gradually closes over the charges of infusible product until the margins of the strip are laid over one another;

sealing means acting on the lengthways margins of the tubular receptacle and crossways at regular intervals in order to form the tubular receptacle into a series of closed filter bags;

means for cutting the tubular receptacle at regular intervals so as to separate the filter bags.

2. The machine according to claim 1, wherein the wheel has an internal cavity intercommunicating with the radial cavities, the said actuating means comprising a cam, housed inside the cavity in the wheel and acting on the pins to push them out of, or make them retract into, the radial cavities.

3. The machine according to claim 1, further comprising means for feeding tea bag pickup tags driven in synchrony with the wheel, the latter being made in two cylindrical, coaxial halves adjacent to each other along the axis of rotation, and together defining the said lateral surface, the first half supporting the strip of porous material and the second half working in the combination with the pickup tag feed means to receive the pickup tags and place them close to the first margin of the strip and at regular intervals along the lengthways direction of feed, the said wheel being equipped with means for holding the pickup tags.

4. The machine according to claim 1 wherein the said means for continuously feeding the strip of porous material comprises a roll on which the continuous strip of porous material is wound, a series of rollers defining the feed path of the strip of porous material and a sensor which controls the tension of the strip of porous material and the speed at which the strip is unwound.

5. The machine according to claim 1 wherein the said actuating means comprises:

a right-angled lever mounting the distributor nozzle at one end and having an actuating end and an intermediate joint located between the said two ends;

a first arm coaxial with and rotating on the wheel, mounting an actuator connected to the actuating end of the right-angled lever;

and a second arm, also coaxial with and rotating on the wheel and mounting a pivot for the intermediate joint of the right-angled lever, the said first and second arms being motor driven to swing relative to each other and relative to the wheel to swing the nozzle accordingly to allow it to describe the said path round the pins remaining constantly at the same distance from the lateral surface of the wheel.

6. The machine according to claim 1 wherein the said means for holding at least one second section of thread comprises at least one hot air heater mounted peripherally in relation to the wheel at a select distance from the first margin of the strip of porous material and designed to melt spots of adhesive on the strip of porous material at least at the second lengthways sections of the loops of thread, the said means for holding at least one second section of thread further comprising at least one pressure element designed to press the thread onto the strip of porous material, using the wheel as contact surface.

7. The machine according to claim 2 wherein the pickup tags are made of heat-sealable material, the said machine further comprising heating means interacting with the facing surfaces of opposite sides of the pickup tags so as to melt the heat-sealable material, and a pressure element to interact with the wheel to close the said sides against each other to attach them securely to the thread.

8. The machine according to claim 1 wherein the said feeder means includes a rotor connected with a container with infusible product in loose form in it, the said rotor having feed cavities located at regular intervals round its outer surface, the strip of porous material being able to move at a tangent to the rotor at a synchronized speed in order to receive the charges of infusible product at regular intervals along the lengthways direction of feed.

9. The machine according to claim 1 wherein the said folding means comprises:

a first flat folding element located on the side of the feeder means, over the strip, and having an edge that is angled in relation to the second margin of the strip, opposite the first margin;

a contact surface for the strip of porous material at an angle to the plane in which the first flat folding element lies;

a pressure foot whose front interacts with the contact surface to press the strip against it, the said pressure foot having a back which, together with the front, defines an edge that intersects the edge of the first flat folding element so that together they define a triangular flap on the second margin of the strip;

a second flat folding element moving in parallel and at right angles to the strip of porous material and being equipped with a strip pressure roller which, acting in combination with the back, folds the flap so as to gradually lay the second margin of the strip over the first margin.

10. The machine according to claim 3 wherein the said pickup tag feed means comprises a roll of pickup tags in the form of a continuous strip made of heat-sealable material and a strip unwinding unit equipped with a rotary knife mounted peripherally in relation to the wheel, the said knife being synchronized with the wheel to cut the strip of pickup tags at regular intervals, causing the tags to move along the wheel at a tangent until they are stopped by a pair of pins on the second wheel half.

11. The machine according to claim 3 wherein the said pickup tag holding means comprises suction cups mounted on the second half of the wheel.

12. A process for making complete tea bags comprising a filter bag containing infusible product for infusion in a liquid and formed of sheets of porous material, sealed together along their margins to form sealed edges of the filter bag, and comprising also a thread used for holding the filter bag during infusion, the process comprising the steps of:

feeding a continuous strip of porous material along a lengthways direction of feed;

laying on the strip a thread following a continuous path including a series of closed loops at regular intervals, each loop having two mutually intersecting, lengthways and crossways sections, a first lengthways section of which is released close to a first margin of the strip, and a second crossways section which is arranged in such a way that it crosses the first margin, the said path including a portion of loop of thread protruding from the first margin;

holding at least one second thread lengthways section against the strip of porous material, the said second thread lengthways section being located further away from the first margin than the first lengthways section;

depositing a succession of charges of infusible product on top of the loops of thread on the strip of porous material;

folding the second margin of the strip over the first margin to form a tubular receptacle that gradually closes over the charges of product until the margins of the strip are laid over each other;

sealing the tubular receptacle lengthways along the margins and crossways at regular intervals to form the tubular receptacle into sealed filter bags;

cutting the tubular receptacle at regular intervals to separate the filter bags.

13. The process according to claim 12 wherein the said holding step comprises localized heating of the strip of porous material at the second lengthways section of thread.

14. The process according to claim 12 wherein the said thread path is defined by the winding of the thread round the pins that move at right angles to the strip of porous material and in synchrony with the movement of the strip, the said winding action being effected by a thread distributor nozzle placed over the strip of porous material and being driven along the path by related actuator means.

15. The process according to claim 12 further comprising a step of synchronized feeding and positioning of tea bag pickup tags close to the first margin of the strip where the loops are, the said thread laying step being effected to position the portion of loop above a pickup tag laid out flat, the said process further comprising a step of gradually folding the pickup tag onto itself starting with flaps of the pickup tab co-planar and ending with the flaps overlaid, the said flaps being on either side of the portion of loop and fixed securely to the latter.

16. The process according to claim 15 wherein the flaps are fixed to the portion of loop by heat-sealing.

17. The process according to claim 15 further comprising scoring the pickup tag along a crossways line before folding.

18. The process according to claim 15 further comprising rotating the pickup tag about the first margin of the strip of porous material to flip the tag onto the strip.

19. A complete tea bag comprising a filter bag containing a charge of product for infusion in a liquid and formed of sheets of porous material sealed together along their margins to form edges that seal the filter bag, and comprising also a thread for holding the filter bag during infusion, the tea bag further comprising a thread having sections which cross the edges of the filter bag and intersect to form a closed loop, a first part of which is located inside the filter bag and a second part being instead located between the sealed margins of the same edge of the filter bag, the said thread being arranged in the filter bag such that when just one of the sections of thread is pulled, the thread slides through the edge of the filter bag to shorten the first section of the loop, tightening it against the edge of the filter bag and creating a resistant fastening of the thread on the filter bag during infusion.

20. The tea bag according to claim 19 wherein one of the sections of thread is placed lengthways and the other crossways with respect to the edge.

21. The tea bag according to claim 20 wherein the sections differ in length so as to offer a different resistance to the pulling action.

22. The tea bag according to claim 20 wherein the section of thread that is placed lengthways to the edge is longer than the crossways section.

23. The tea bag according to claim 19 wherein the thread is attached to the edge to form a portion of loop outside and protruding from the filter bag to which a tag used for picking up the filter bag is fixed.

24. The machine according to claim 1 wherein the said folding means consist of a pressure foot, a folding element and a stop finger, interacting with each other, the said pressure foot mounting a first elongated element placed over the strip of porous material lengthways with respect to the said strip, the folding element in turn mounting a second elongated element placed crossways over the strip of porous material and oriented at an angle to the first elongated element, the finger being mounted further upstream along the strip direction of feed, one of the margins of the strip of porous material winding once round the first folding element and then, passing between the first and second folding elements, a second time round the second folding element, in the opposite direction, to form a flap which is stopped at the back by the finger, is laid over the sheet of the strip that is not folded, and which forms the tubular receptacle as the strip moves along the direction of feed.

25. The tea bag according to claim 20 wherein the thread is attached to the edge to form a portion of loop outside and protruding from the filter bag to which a tag used for picking up the filter bag is fixed.

26. The tea bag according to claim 21 wherein the thread is attached to the edge to form a portion of loop outside and protruding from the filter bag to which a tag used for picking up the filter bag is fixed.

27. The tea bag according to claim 22 wherein the thread is attached to the edge to form a portion of loop outside and protruding from the filter bag to which a tag used for picking up the filter bag is fixed.

* * * * *